US008596347B2

(12) United States Patent
Valencia et al.

(10) Patent No.: US 8,596,347 B2
(45) Date of Patent: Dec. 3, 2013

(54) DRILLABLE SLIP WITH BUTTONS AND CAST IRON WICKERS

(75) Inventors: Anthony Valencia, Marlow, OK (US); Kevin Ray Manke, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 211 days.

(21) Appl. No.: 12/909,348

(22) Filed: Oct. 21, 2010

(65) Prior Publication Data

US 2012/0097384 A1 Apr. 26, 2012

(51) Int. Cl.
*E21B 33/13* (2006.01)

(52) U.S. Cl.
USPC ..... 166/134; 166/179; 166/208

(58) Field of Classification Search
USPC ..... 166/179, 208, 134
See application file for complete search history.

(56) References Cited

U.S. PATENT DOCUMENTS

| | | | |
|---|---|---|---|
| 2,368,928 | A | 2/1945 | King |
| 3,339,637 | A | 9/1967 | Holden |
| 4,151,875 | A | 5/1979 | Sullaway |
| 4,185,689 | A | 1/1980 | Harris |
| 4,457,369 | A | 7/1984 | Henderson |
| 4,765,404 | A | 8/1988 | Bailey et al. |
| 5,224,540 | A | 7/1993 | Streich et al. |
| 5,390,737 | A | 2/1995 | Jacobi et al. |
| 5,701,959 | A | 12/1997 | Hushbeck et al. |
| 5,839,515 | A | 11/1998 | Yuan et al. |
| 5,857,520 | A | 1/1999 | Mullen et al. |
| 5,944,102 | A | 8/1999 | Kilgore et al. |
| 5,984,007 | A | 11/1999 | Yuan et al. |
| 6,102,117 | A | 8/2000 | Swor et al. |
| 6,132,844 | A | 10/2000 | Altshuler et al. |
| 6,315,041 | B1 | 11/2001 | Carlisle et al. |
| 6,474,419 | B2 | 11/2002 | Maier et al. |
| 6,481,497 | B2 | 11/2002 | Swor et al. |
| 6,598,672 | B2 | 7/2003 | Bell et al. |
| 6,695,051 | B2 | 2/2004 | Smith et al. |
| 6,793,022 | B2 | 9/2004 | Vick et al. |
| 7,373,973 | B2 | 5/2008 | Smith et al. |
| 7,472,746 | B2 | 1/2009 | Maier |

(Continued)

FOREIGN PATENT DOCUMENTS

| | | |
|---|---|---|
| EP | 1 052 369 A2 | 11/2000 |
| EP | 1 052 369 A3 | 6/2001 |

(Continued)

OTHER PUBLICATIONS

Halliburton Sales & Service Catalog 43, pp. 2561-2562 and 2556-2557 (1985).

(Continued)

*Primary Examiner* — Yong-Suk (Philip) Ro
(74) *Attorney, Agent, or Firm* — John Wustenberg; McAfee & Taft

(57) ABSTRACT

A slip for use in the anchoring of a downhole tool in the well casing wherein the anchors include a plurality of buttons and at least one wicker. The slip is positioned about a mandrel and radially expands upon the application of force. The buttons and wicker first engage the casing in response to a first force, and the wicker deformably engages the casing in response to a second force. The second force causes the wicker to cut into and deform the casing, thereby anchoring the downhole tool for high-pressure operations.

20 Claims, 6 Drawing Sheets

(56) References Cited

U.S. PATENT DOCUMENTS

| | | | |
|---|---|---|---|
| 7,779,927 | B2 | 8/2010 | Turley et al. |
| 2003/0150607 | A1 | 8/2003 | Roberts |
| 2004/0045723 | A1 | 3/2004 | Slup et al. |
| 2005/0121202 | A1 | 6/2005 | Abercrombie Simpson et al. |
| 2009/0038790 | A1 * | 2/2009 | Barlow ..... 166/89.2 |

FOREIGN PATENT DOCUMENTS

| | | | |
|---|---|---|---|
| EP | 1 197 632 | A2 | 4/2002 |
| WO | WO 2004070163 | A1 | 8/2004 |
| WO | WO2007058864 | A1 | 5/2007 |
| WO | WO 2009019483 | A2 | 2/2009 |
| WO | WO 2009019483 | A3 | 2/2009 |

OTHER PUBLICATIONS

International Search Report and Written Opinion of the International Searching Authority dated Jan. 19, 2011, in corresponding PCT Application No. PCT/GB2010/001850.

International Search Report and Written Opinion of the International Searching Authority dated Mar. 8, 2013, in corresponding PCT Application No. PCT/GB2011/001517.

International Preliminary Report on Patentability dated May 2, 2013, in corresponding PCT Application No. PCT/GB2011/001517.

* cited by examiner

DRILLABLE SLIP WITH BUTTONS AND CAST IRON WICKERS

BACKGROUND

This invention relates generally to downhole tools for use in oil and gas wellbores, and methods of anchoring such apparatuses within the casing of the wellbore. This invention particularly relates to improving the engagement of slip elements within a casing or tubing. These slip elements are commonly used in setting or anchoring of a downhole drillable packer, bridge plug and frac plug tools.

In drilling or reworking oil wells, many varieties of downhole tools are used. For example, but not by way of limitation, it is often desirable to seal tubing or other pipe in the casing of the well by pumping cement or other slurry down the tubing, and forcing the slurry around the annulus of the tubing or out into a formation. It then becomes necessary to seal the tubing with respect to the well easing and to prevent the fluid pressure of the slurry from lifting the tubing out of the well, or for otherwise isolating specific zones in a well. Downhole tools referred to as packers, bridge plugs and frac plugs are designed for these general purposes, and are well known in the art of producing oil and gas.

Both packers and bridge plugs are used to isolate the portion of the well below the packer or bridge plug from the portion of the well thereabove. Accordingly, packers and bridge plugs may experience a high differential pressure, and must be capable of withstanding the pressure so that the packer or bridge plug seals the well, and does not move in the well after being set.

Packers and bridge plugs used with a downhole tool both make use of metallic or non-metallic slip assemblies, or slips, that are initially retained in close proximity to a mandrel. These packers and bridge plugs are forced outwardly away from the mandrel upon the downhole tool being set to engage a casing previously installed within an open wellbore. Upon positioning the downhole tool at the desired depth, or position, a setting tool or other means of exerting force, or loading, upon the downhole tool forces the slips to expand radially outward against the inside of the casing to anchor the packer, or bridge plug, so that the downhole tool will not move relative to the casing. Once set, additional force, in the form of increased hydraulic pressure, is commonly applied to further set the downhole tool. Unfortunately, the increased pressure commonly causes the downhole tool to slip up or down the casing.

To prevent slipping of the downhole tool, cylindrically shaped inserts, or buttons, are secured to the slip segments to enhance the ability of the slip segments to engage the well casing. The buttons must be of sufficient hardness to be able to partially penetrate, or bite into the surface of the well casing, which is typically steel. Unfortunately, the buttons will occasionally disintegrate under increased force, or higher pressures, thereby allowing the downhole tool to slide within the well.

Alternatively, slip segments may have a plurality of wickers positioned about them to engage and secure the slip segments within the casing. The wickers must be sufficiently hard to engage and deformably cut into the well casing. Unfortunately, the amount of force required to cause the plurality of wickers to engage the well casing is significant, and often exceeds that of a setting tool. Thus, until sufficient force is exerted upon the wickers, the wickers may not fully engage the casing, thereby allowing the tool to slide significant distances within the well prior to engaging the casing.

SUMMARY

In one embodiment, an apparatus for anchoring a downhole tool in a well is provided. The apparatus comprises a mandrel and a slip assembly. The slip assembly is positioned on the mandrel. The slip assembly has at least one slip ring. The slip ring has an outer surface. A plurality of buttons are secured to and extending outwardly from the outer surface of the slip ring. The buttons define a first anchor. There are a plurality of wickers integrally formed on the slip ring. The plurality of wickers define a second anchor.

In another embodiment, a two-stage downhole anchor is provided. The two-stage downhole anchor comprises a mandrel and a slip assembly. The slip assembly is positioned on the mandrel. The slip assembly has at least one outwardly expandable slip ring and at least one slip wedge. The slip ring defines a first surface and the slip wedge defines a complementary second surface. The first surface is positioned against the complementary second surface of the slip wedge. The slip wedge and slip ring are movable relative to one another when force is applied to the slip assembly, whereby the slip ring will expand radially outward in response to such movement. There are a plurality of buttons secured to the slip ring, wherein the buttons define a first-stage anchor. There are a plurality of wickers defined on the slip ring, wherein the plurality of wickers define a second-stage anchor.

In yet another embodiment, a force-responsive apparatus for anchoring a downhole tool in a well is provided. The force responsive apparatus comprises a mandrel and at least one slip assembly that is positioned on the mandrel. The slip assembly has at least one slip ring and at least one slip wedge. Each slip ring has a plurality of radially expandable slip segments. There are a plurality of buttons secured to, and extending outwardly from, the slip segments, wherein the buttons are positioned to engage an inner wall of the casing in response to a first input force. There are a plurality of wickers defined on the slip ring. Each of the wickers have a cutting edge extending therefrom, wherein the wicker are positioned to deformably engage the inner wall of the casing in response to a second input force.

In still another embodiment, an apparatus for anchoring a downhole tool in a well is provided. The apparatus comprises a mandrel and a slip assembly. The slip assembly is positioned on the mandrel. The slip assembly has at least one slip ring. The slip ring has an outer surface. At least one button is secured to and extending outwardly from the outer surface of the slip ring. The button defines a first anchor. There is at least one wicker integrally formed on the slip ring. The wicker defines a second anchor.

DETAILED DESCRIPTION

Figure 1:
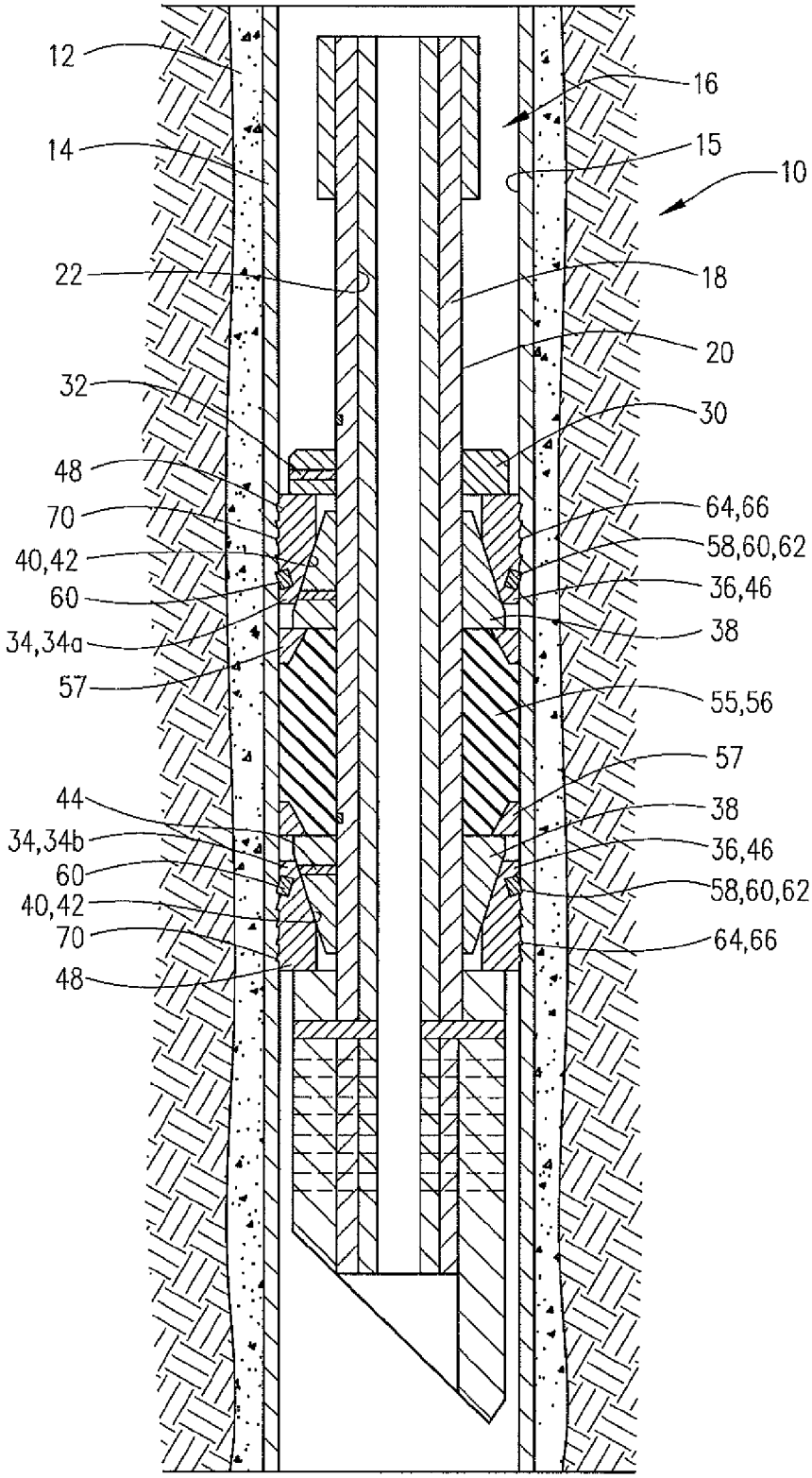
FIG. 1 is a cross-section of a downhole tool disposed in a well with a slip assembly.

Referring to the drawings, FIG. 1 illustrates well 10 having wellbore 12 with casing 14 cemented therein. Casing 14 has inner wall 15. Downhole tool 16 includes mandrel 18 with an outer surface 20 and an inner surface 22.

Figure 2:
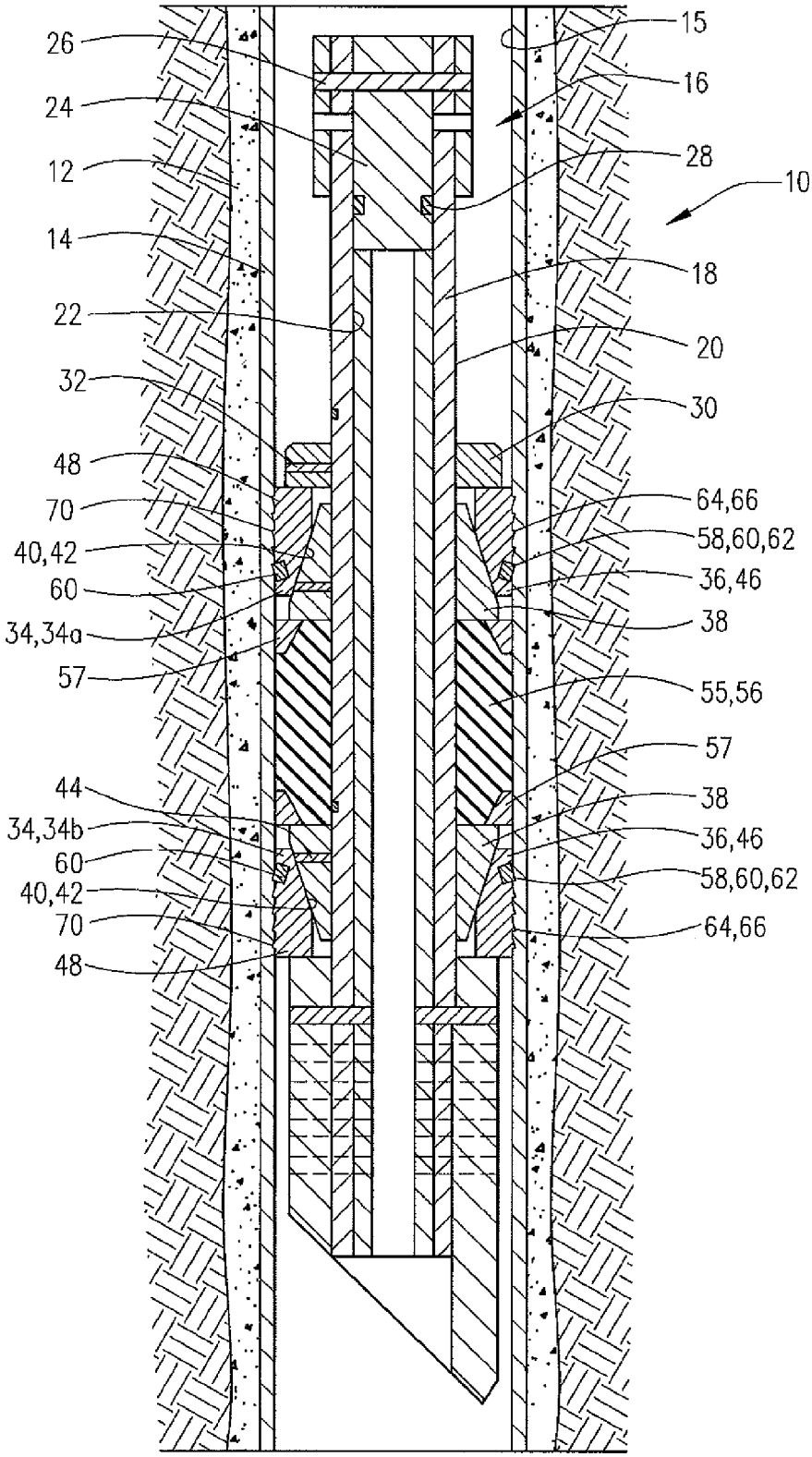
FIG. 2 is a cross-section of an alternative downhole tool disposed in a well with a slip assembly.

By way of a non-limiting example, downhole tool 16 illustrated in FIG. 1 is referred to as a packer, and allows fluid communication therethrough. The packer illustrated may be used as a frac plug. In another non-limiting example, downhole tool 16 illustrated in FIG. 2 is referred to as bridge plug. For this second non-limiting example, downhole tool 16 has optional plug 24 pinned within mandrel 18 by radially oriented pins 26. Plug 24 has a seal 28 located between plug 24 and mandrel 18. Without plug 24, downhole tool 16 is suited for use as, and referred to as a packer.

As illustrated in FIGS. 1 and 2, spacer ring 30 is mounted to mandrel 18 with a pin 32. Slip assembly 34 is positioned on and/or disposed about mandrel 18. Spacer ring 30 provides an abutment, which serves to axially retain slip assembly 34. As illustrated, downhole tool 16 has two slip assemblies 34, namely a first slip assembly and second slip assembly, depicted in FIGS. 1 and 2 as first and second slip assemblies 34*a* and 34*b* for ease of reference. Slip assemblies 34*a* and 34*b* provide anchoring for downhole tool 16 to casing 14 within well 10. The structure of slip assemblies 34*a* and 34*b* is identical, and only the orientation and position on downhole tool 16 are different. As illustrated in FIG. 2, each slip assembly 34 includes at least one slip ring 36 and at least one slip wedge 38. Slip ring 36 has an inclined/wedge-shaped first surface 40 positioned proximate to an inclined/wedge-shaped complementary second surface 42 of slip wedge 38. Slip assembly 34 is depicted in FIG. 2 as being pinned into place with pins 44.

Figure 3:
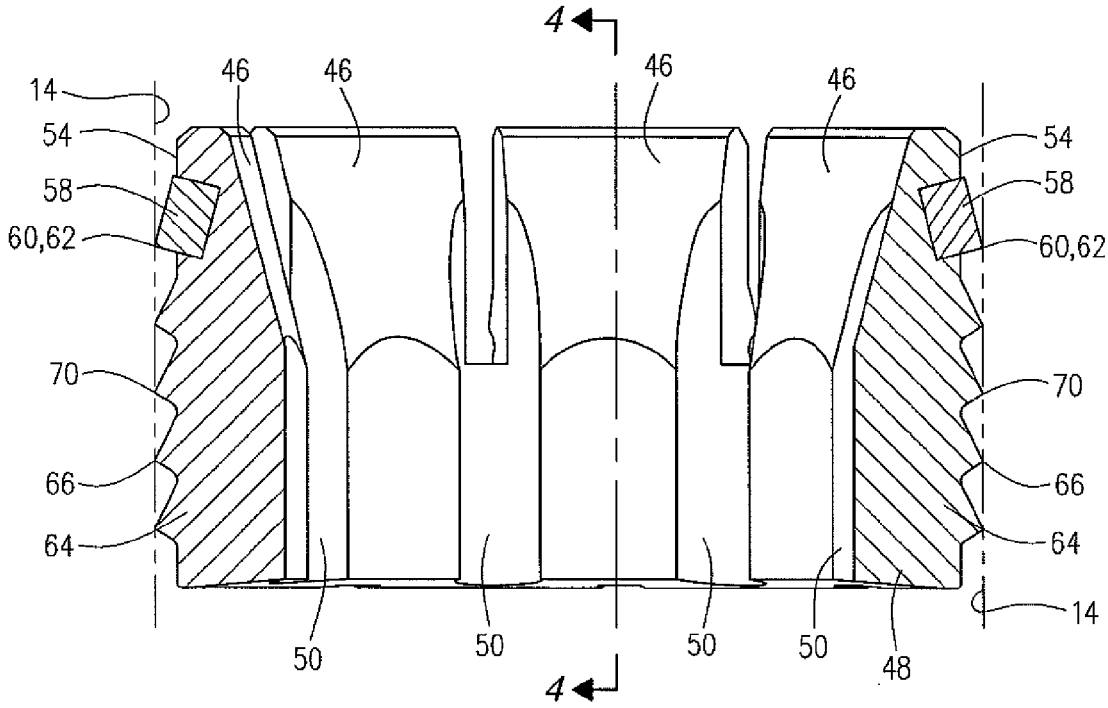
FIG. 3 is a cross-sectional view of the slip segment.
Figure 4:
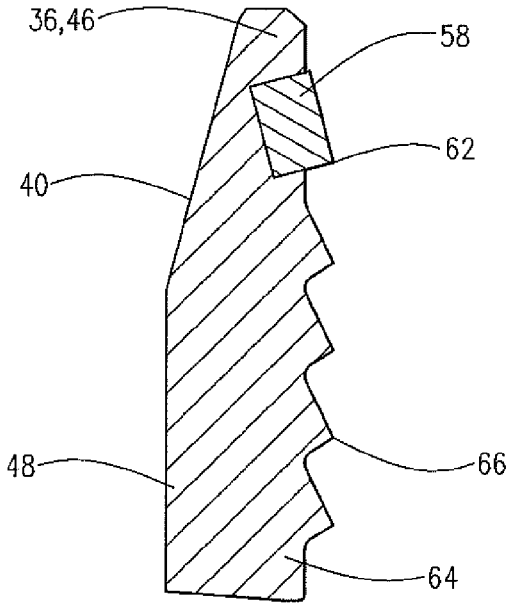
FIG. 4 is a cross-sectional view of the slip segment having a plurality of wickets taken along section line 4-4 of FIG. 3.
Figure 5:
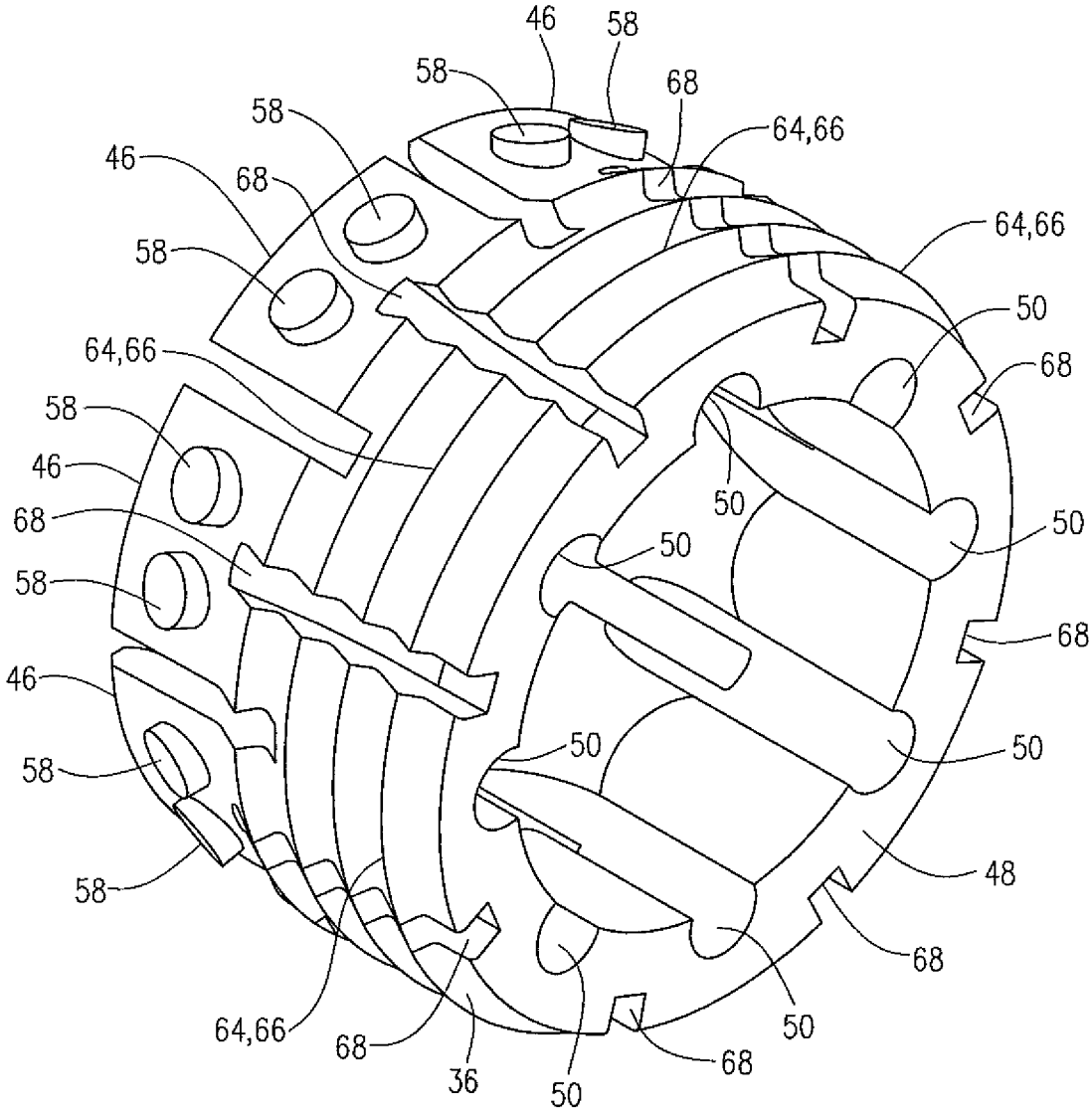
FIG. 5 is a perspective view of the slip segment.

Slip ring 36, shown in FIGS. 3 and 4, is an expandable slip ring 36 and has a plurality of slip segments 46 attached to main slip ring body 48. Slip segments 46 are separated by fracture channel 50. Fracture channel 50 provides a weakened point in slip ring 36 for slip segments 46 to break apart from each other when sufficient forces are radially exerted on the interior of slip ring 36. Without limiting the invention, slip ring 36 may include a plurality of slip segments 46. As illustrated in FIGS. 3 and 4, slip ring 36 has eight slip segments 46.

Slip rings 36 are comprised of a drillable material and may be, for example, cast iron or a molded phenolic. Slip rings 36 may be made from other drillable materials such as drillable metals, composites and engineering grade plastics. The remainder of slip assembly 34 and other components of the tool may likewise be made from drillable materials.

Figure 6:
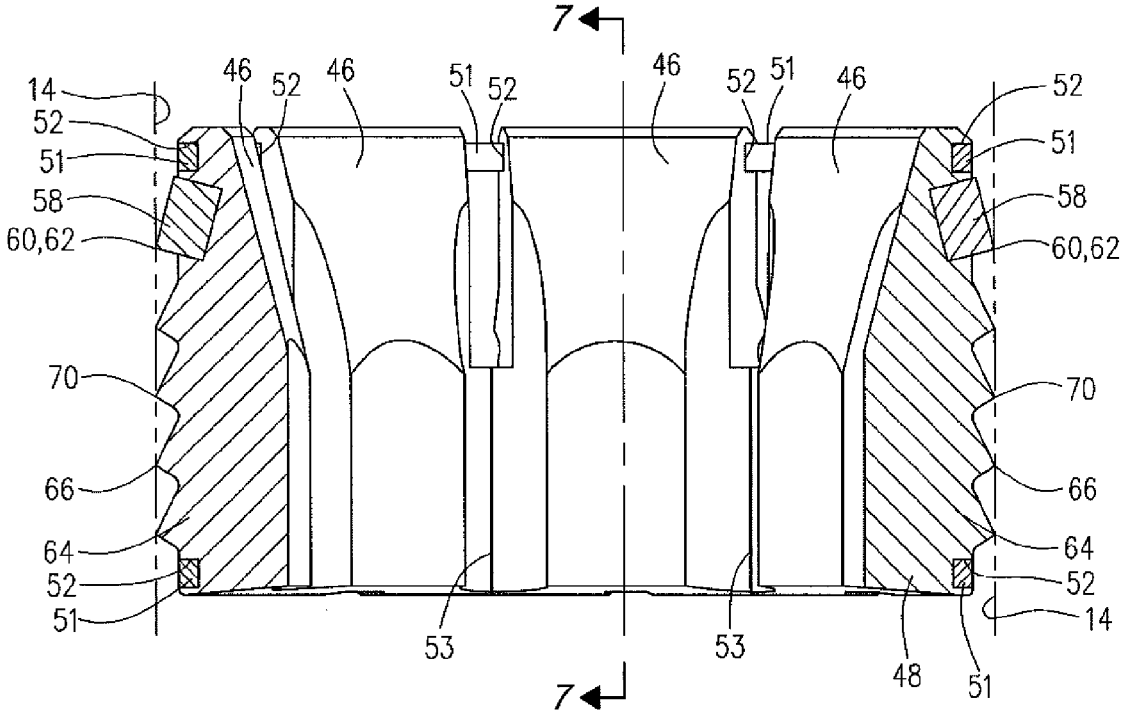
FIG. 6 is a cross-sectional view of the slip segment with a frangible retaining ring.

Although main slip ring body 48 is illustrated as a fracturable slip ring 36 in FIGS. 3 and 4, it is anticipated that main slip ring body 48 may have separated slip segments 46. In this configuration, all of slip segments 46 are secured by frangible retaining ring 51, thereby forming main slip ring body 48. An example is illustrated in FIG. 6. Similar to the fracturable slip ring 36, slip ring 36 with separated slip segments 46 may also have a plurality of slip segments 46. As illustrated in FIG. 6, fracturable slip ring 36 depicts portions of four of eight slip segments 46.

Figure 7:
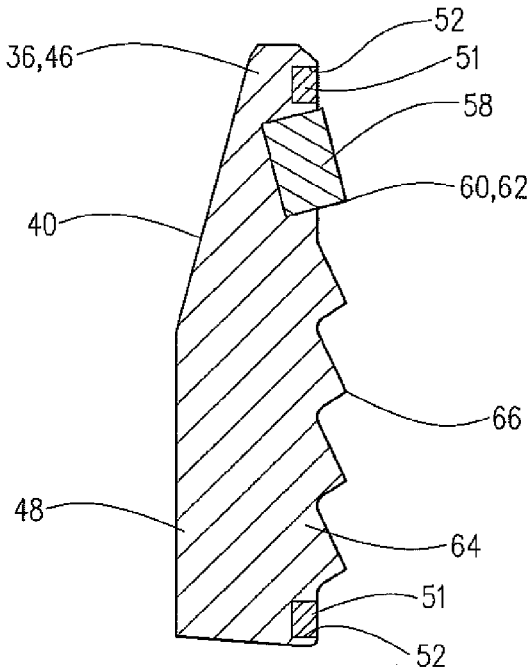
FIG. 7 is a cross-sectional view of the slip segment having a plurality of wickers and a frangible retaining ring taken along section line 7-7 of FIG. 3.
Figure 8:
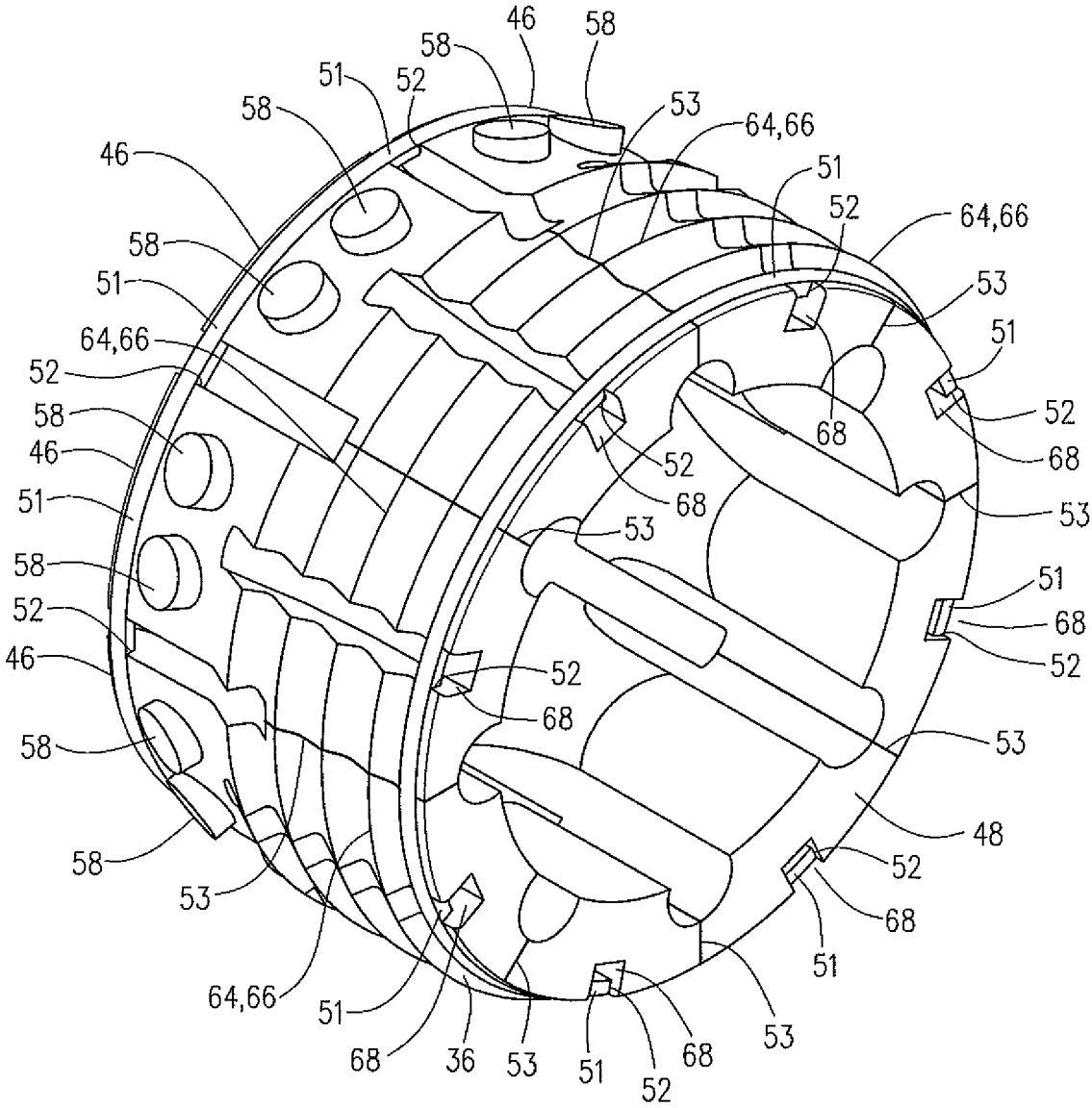
FIG. 8 is a perspective view of the slip segment with a frangible retaining ring.

Referring to FIGS. 6-8, when slip ring 36 is configured with separated slip segments 46, frangible retaining ring 51 is disposed in grooves 52 positioned upon outer surface 54 of slip ring 36. Outer surface 54 of slip ring 36 is illustrated as projecting radially outward towards casing 14. Frangible retaining ring 51 will retain slip ring 36 in an unset position about mandrel 18 when downhole tool 16 is lowered into well 10. Joint 53, illustrated on FIGS. 6 and 8, is the separation point of separated slip segments 46. Each separated slip segment 46 touches the adjoining separated slip segment 46 along joint 53.

Slip rings 36 may be moved or radially expanded from the unset to the set position, which is illustrated in FIGS. 1 and 2, in which slip rings 36 engage casing 14 to hold downhole tool 16 in well 10. Frangible retaining rings 51 will break as slip rings 36 expand radially outward, but they must also have sufficient strength to prevent premature breakage. A large load, for example, 1,200 pounds of force applied axially may be necessary to generate enough radial force to break frangible retaining rings 51 when slip rings 36 are moved to the unset position.

Frangible retaining ring 51 may be made from a metal, or a composite, such as a fiberglass. However, frangible retaining ring 51 may comprise any material, preferably a drillable material, which will provide adequate strength to prevent premature breakage.

Slip assemblies 34*a* and 34*b* are illustrated in FIGS. 1 and 2 as being separated by packer element assembly 55. As illustrated, packer element assembly 55 includes at least one expandable packer element 56, which is positioned between slip wedges 38. Packer shoes 57 may provide axial support to the ends of packer element assembly 55.

Referring to FIGS. 1-8, a plurality of inserts or buttons 58 are secured to outer surface 54 of slip ring 36 by adhesive, or by other means known to those skilled in the art. Buttons 58 extend radially outward from outer surface 54, and are positioned to engage casing 14, or in particular, an inner wall of casing 14, in response to a first input force, thereby setting first-stage anchor 60 for downhole tool 16. There is at least one button 58 secured to and carried by each slip segment 46 of slip ring 36.

Buttons 58 are comprised of a material having sufficient hardness to penetrate or bite into casing 14. Each button 58 has button edge 62 defining the point of engagement for button 58 with casing 14. Collectively, when buttons 58 engage inner wall 15 of casing 14, buttons 58 define the aforementioned first-stage anchor 60, also referred to as a first anchor, for slip ring 36.

Preferably, buttons 58 are made from a material selected from the group consisting of tungsten carbide, ceramic, metallic-ceramic, zirconia-ceramic titanium, molybdenum, nickel and combinations thereof. Additionally, buttons 58 may be, for example, similar in material and form as those described in U.S. Pat. No. 5,984,007, which is incorporated by reference herein. Buttons 58 may be made from any material that can pierce the casing or is harder than the casing grade utilized for casing 14. Casing grades are the industry standardized measures of casing-strength properties. Since most oilfield casing is of approximately the same chemistry (typically steel), and differs only in the heat treatment applied, the grading system provides for standardized strengths of casing to be manufactured and used in wellbores.

Slip ring 36 also has a plurality of wickers 64 integrally defined thereon. Wickers 64 may be formed on slip ring 36 or they may be secured thereto. Wickers 64 define cutting edges 66, which securely engage inner wall 15 of casing 14, thereby retaining downhole tool 16 within casing 14. Cutting edges 66 are the outermost edge of wickers 64 for engaging casing 14. As illustrated in FIGS. 1-8, each wicker 64 is circumferentially defined on slip ring 36 with a plurality of longitudinal channels 68 intersecting wicker 64 on each slip segment 46. Each wicker 64 radially extends from outer surface 54 of slip ring 36.

As illustrated in FIGS. 1-8, wickers 64 are integrally formed on and from slip ring 36, and more particular, main slip ring body 48. Thus, each slip segment 46 has a plurality of wickers 64 defined thereon. In the alternative, wickers 64 may be secured to slip ring 36, or inserted into slip ring 36 by other means known to those skilled in the art.

As illustrated in FIGS. 1-3, wickers 64 employing cutting edges 66 are positioned to deformably engage casing 14 by cutting into or penetrating casing 14. This action securely anchors downhole tool 16. Because of the large pressure required to generate sufficient force for cutting edges 66 to deformably engage casing 14, buttons 58 provide for the initial anchoring of downhole tool 16.

Wickers 64 define a second-stage anchor 70, also referred to as a second set of anchors, for slip ring 36 as part of downhole tool 16. In particular, cutting edges 66 of wickers 64 define second-stage anchor 70. Collectively, buttons 58 and cutting edges 66 of wickers 64 form an expandable two-stage downhole anchor.

In operation, downhole tool 16 is positioned at the desired depth or location by a setting tool, such as a wireline. The wireline exerts an initial or first force upon slip assembly 34, causing slip wedge 38 and slip ring 36 to move relative to one another, which radially exerts an internal radial force upon slip ring 36. Slip ring 36 radially expands outward as complementary second surface 42 slides against first surface 40. The sliding, effect of complementary second surface 42 against first surface 40 causes slip ring 36 to force buttons 58 against the inner wall of casing 14, which in turn causes button edge 62 of buttons 58 to engage the inner wall of casing 14. As the radial force is increased, buttons 58 penetrate into inner wall 15 of casing 14. This radial force is sufficient to penetrate the casing grade for the particular casing 14 utilized.

Cutting edges 66 of wickers 64 may engage the inner wall of casing 14 at the same time buttons 58 engage inner wall 15 of casing 14. However, the exertion of a second, and substantially greater force upon downhole tool 16 and slip assembly 34 causes complementary second surface 42 of slip wedge 38 to further slide against first surface 40 of slip ring 36. The second force causes slip ring 36 to further radially expand outward, and forces cutting edges 66 to deformably engage the inner wall 15 of casing 14. This second force is the point when button 58 reaches its shear value, or when button 58 has been compromised to the point of load sharing or load transfer. The second force may be any form of force exerted upon slip assembly 34, but is commonly a hydraulic force. This force responsive action sets the aforementioned two-stage anchor of downhole tool 16. Accordingly, downhole tool 16, as associated with the aforementioned elements, forms a force responsive apparatus for anchoring downhole tool 16.

Because buttons edges 62 and cutting edges 66 engage casing 14, each button 58 and wicker 64 must have a hardness rating exceeding that of casing 14. By way of a non-limiting example, wicker 64 has a hardness rating capable of deforming an API P110 casing upon application of a sufficient force to slip assembly 34. The result of the application of the sufficient force to wicker 64 is that downhole tool 16 is set, but buttons 58 are crushed. Sufficient forces to set wicker 64 often exceed the crush strength of buttons 58, especially ones that are ceramic material.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. An apparatus for anchoring a downhole tool in a well comprising:

a mandrel;

a slip assembly positioned on said mandrel, said slip assembly having at least one slip ring with an outer surface;

a plurality of buttons secured to and extending outwardly from said outer surface, said buttons defining a first anchor, wherein said slip ring radially expands outward in response to a first force so that said buttons engage an inner wall of said well upon application of said first input force; and a plurality of wickers integrally formed on said slip ring and defining a second anchor, wherein said slip ring further radially expands outward in response to a second force, which is greater than a crush strength of said buttons, so that said wickers engage and deform said inner wall of said well upon application of said second input force.

2. The apparatus of claim 1, wherein each of said buttons further define a button edge thereon, said button edge for engaging a casing.

3. The apparatus of claim 1, wherein each of said plurality of said wickers has a cutting edge defined thereon and extending radially outward from a main slip ring body.

4. The apparatus of claim 1, wherein said slip ring further comprises a plurality of slip segments defined by fracture channel, wherein each slip segment defines a plurality of wickers thereon and carries at least one button.

5. The apparatus of claim 1, wherein said slip ring includes a plurality of separated slip segments secured by a frangible retaining band, each said separated slip segment having a plurality of wickers defined thereon and carrying at least one button.

6. The apparatus of claim 1, wherein the buttons are manufactured from a material selected from the group consisting of tungsten carbide, ceramic, metallic-ceramic, zirconia-ceramic titanium, molybdenum, nickel, and combinations thereof.

7. The apparatus of claim 1, wherein said buttons are manufactured from a material having a hardness greater than a casing grade utilized for a casing in said well.

8. A two-stage downhole anchor comprising:

a mandrel;

a slip assembly positioned on said mandrel, said slip assembly having at least one outwardly expandable slip ring and at least one slip wedge, wherein said slip wedge and slip ring are movable relative to one another when force is applied to said slip assembly, whereby said slip ring will expand radially outward in response to such movement;

a plurality of buttons secured to said slip ring, wherein said buttons define a first-stage anchor, wherein said slip ring and said slip wedge move relative to each other in response to a first force to said slip assembly so that said buttons penetrate into a casing thereby setting said first-state anchor and securing said mandrel; and a plurality of wickers defined on said slip ring, wherein said plurality of wickers define a second-stage anchor, wherein said slip ring and slip wedge further move relative to each other in response to a second force, which is greater than a crush strength of said buttons, so that said wickers deformably engage said casing upon application of said second force.

9. The two-stage downhole anchor of claim 8, wherein said slip ring further comprises a plurality of slip segments defined by a fracture channel, wherein each of said plurality of slip segments has a plurality of wickers defined thereon and carries at least one button.

10. The two-stage downhole anchor of claim 8, wherein said slip ring further comprises a plurality of separated slip segments secured by a frangible retaining band, said separated slip segments defining a plurality of wickers thereon and carrying at least one button.

11. The two-stage downhole anchor of claim 8, wherein each of said plurality of wickers is integrally formed from said slip ring.

12. A force responsive apparatus for anchoring a downhole tool in a well comprising:

a mandrel;

at least one slip assembly positioned on said mandrel, said slip assembly having at least one slip ring and at least one slip wedge, wherein each slip ring has a plurality of radially expandable slip segments;

a plurality of buttons secured to and extending outwardly from said slip segments, wherein said buttons are positioned to engage an inner wall of a casing in response to a first input force, wherein said buttons penetrate into said inner wall of said casing upon application of said first input force, said slip ring and said slip wedge move relative to each other in response to said first input force, thereby forcing said slip segments to radially expand; and a plurality of wickers defined on said slip ring, wherein each said wicker has a cutting edge extending therefrom, wherein said wickers are positioned to deformably engage said inner wall of said casing in response to a second input force, wherein said cutting edges of said wickers engage and deform said inner wall of said casing upon application of said second input force, said second input force being greater than a crush strength of said buttons, wherein said slip ring and said slip wedge further move relative to each other in response to said second input force, thereby forcing said slip segments to further radially expand.

13. The force responsive apparatus of claim 12, wherein said engagement of said buttons with said inner wall of said casing define a first-stage anchor.

14. The force responsive apparatus of claim 13, wherein the deformable engagement of said inner wall by said cutting edges of said wickers defines a second-stage anchor.

15. The force responsive apparatus of claim 12, wherein said plurality of radially expandable slip segments are defined by fracture channel on said slip ring, wherein each radially expandable slip segment defines a plurality of wickers thereon and carries at least one button.

16. The force responsive apparatus of claim 12, wherein said plurality of radially expandable slip segments are separated from each other and secured together with a frangible retaining band, wherein each of said plurality of radially expandable slip segments define a plurality of wickers thereon and carry at least one button.

17. The force responsive apparatus of claim 12, wherein the buttons are manufactured from a material selected from the group consisting of tungsten carbide, ceramic, metallic-ceramic, zirconia-ceramic titanium, molybdenum, nickel, and combinations thereof.

18. An apparatus for anchoring a downhole tool in a well comprising:

a mandrel;

a slip assembly positioned on said mandrel, said slip assembly having at least one slip ring with an outer surface;

at least one button secured to and extending outwardly from said outer surface, said button defining a first anchor, wherein said slip ring radially expands outward in response to a first force so that said button engages said inner wall upon application of said first force; and at least one wicker integrally formed on said slip ring and defining a second anchor, wherein said slip ring further radially expands outward in response to a second force, which is greater than A crush strength of said buttons, so that said wicker engages and deforms said inner wall of said well upon application of said second force.

19. The apparatus of claim 18, wherein said button further defines a button edge thereon, said button edge for engaging a casing, and said wicker has a cutting edge defined thereon and extending radially outward from a main slip ring body.

20. The apparatus of claim 18, wherein said button is manufactured from any material that is harder than casing grade.

* * * * *